US005816366A

United States Patent [19]

Briday et al.

[11] Patent Number: 5,816,366

[45] Date of Patent: Oct. 6, 1998

[54] METHOD FOR OPERATING AN INDUSTRIAL TRUCK AND INDUSTRIAL TRUCK PROVIDED FOR IT

[75] Inventors: Yves Briday, Jaunay Clan; Vincent Dubroca, Chatellerault, both of France

[73] Assignee: Linde Aktiengesellschaft, Germany

[21] Appl. No.: 685,853

[22] Filed: Jul. 24, 1996

[30] Foreign Application Priority Data

Aug. 2, 1995 [DE] Germany ..... 195 28 415.1

[51] Int. Cl.[6] ..... B66F 9/20

[52] U.S. Cl. ..... 187/224; 414/629

[58] Field of Search ..... 187/222, 223, 187/224; 414/631, 629

[56] References Cited

U.S. PATENT DOCUMENTS

| | | | |
|---|---|---|---|
| 5,022,496 | 6/1991 | Klopfleisch et al. | 187/224 |
| 5,170,863 | 12/1992 | Devroy | 187/224 |
| 5,329,441 | 7/1994 | Aoki et al. | 187/224 |

*Primary Examiner*—Kenneth Noland
*Attorney, Agent, or Firm*—Thomas R. Shaffer, Esq.

[57] ABSTRACT

In a method for operating an industrial truck, a load-lifting member (1) is moved up and down vertically on a lift mast (2). A discrete control signal is provided to control the vertical speed of the load-lifting member (1) by at least one single or multistage switch. In switching on and then holding the switch (13) in the on position, the load-lifting member (1) is first accelerated from zero to a first vertical speed value ($V_1$) and after the passage of a period of time $T_1$, it is accelerated to a second higher vertical speed value ($V_2$).

7 Claims, 3 Drawing Sheets

METHOD FOR OPERATING AN INDUSTRIAL TRUCK AND INDUSTRIAL TRUCK PROVIDED FOR IT

BACKGROUND OF THE INVENTION

1. Field of the Invention

The invention concerns a method for operating an industrial truck, in which a load-lifting member is moved up and down vertically on a lift mast and the vertical speed of the load-lifting member is specified by an actuation device. But it also concerns an industrial truck provided for this method with a load-lifting member that can be moved vertically on a lift mast and an actuation device for the vertical movement of the load-lifting device.

2. Description of the Prior Art

In the case of the industrial truck, a center pole guided electric lift truck, for example, is involved. The switch for operation and other manipulating elements are usually located in the region of a handle of the center pole in these vehicles. The center pole that is rotatable around a vertical axis is connected directly to a drive wheel and thus serves to steer the lift truck. The actuating device with which the vertical up and down movement of the load-lifting member is controlled on the lift mast is usually located on a housing of the industrial truck. In the industrial truck of the state of the art, this actuating device is generally designed as a continuously moveable lever, which is connected mechanically with the control body of a hydraulic proportioning valve. The vertical speed of the load-lifting member can be adjusted continuously by means of this proportioning valve by sending an appropriate control signal through the actuating device.

The arrangement of the actuating device in the region of the industrial truck housing results in physical stress on the attendant, especially in the case of transfer operations with short travel movements and frequent raising and lowering of the load-lifting member, unleased by continuous switching between the center pole and the actuating device located on the housing.

SUMMARY OF THE INVENTION

The present invention proposes a process of this type and an industrial truck of this type that permit an ergonomically favorable and physically less stressful operation of the actuating device for the up and down movement of the load-lifting member.

This goal is achieved for the above process in that a discrete control signal is emitted for the vertical speed of the load-lifting member by means of at least one single or multistage switch.

The inventive concept consists in generating the control signal for the vertical speed by means of one single or multistage switch. A discrete control signal is produced by the use of a single or multistage switch with which various speed stages of vertical up and down movement of the load-lifting device can be specified by the attendant. As a result of the generation of a discrete control signal, in comparison with the apparatuses of prior art, less sensitiveness is required of the attendant of the industrial truck in operating the actuating device for the vertical speed. Consequently, a single or multistage switch of small construction with short switching paths can be used. Such a switch can be located without difficulty at ergonomically favorable sites of the industrial truck without requiring a fundamental structural change in the industrial truck.

The control signal is expediently fed to a control unit and one or more regulating signals are produced in the control unit for one or more actors. The control signals are detected in the control unit, prepared and converted to regulating signals for the actors. Regulating signals are thus produced, with which the actors provided for the up and down movement of the load-lifting member are actuated.

Advantageously, the load-lifting member is accelerated or braked to a specified vertical speed in which case the course of the vertical speed of the load-lifting member corresponds to a ramp function produced in the control unit. In this manner, jerky speed transitions are avoided and thus, the resulting acceleration forces are reduced.

In a particularly advantageous refinement of the invention, the vertical downward movement and/or the vertical upward movement takes place with two different vertical speeds and the discrete control signals for the vertical upward movement and the discrete control signals for the vertical downward movement are produced with an on-off switch. There is thus an on-off switch for the upward movement and another on-off switch for the downward movement. The on-off switches are designed, for example, as non-locking push buttons. It is possible here to select two different vertical speeds with one on-off switch by selecting the first vertical speed, e.g., by repeated switching on and off and the second vertical speed, e.g., by uninterruptedly holding the on-off switch in the on position.

It is particularly advantageous here if the load-lifting member is first accelerated from zero to a first vertical speed value ($V_1$) with switching on and then holding the on-off switch in the on position and after the passage of a period of time $T_1$, is accelerated after switching on to a second, higher vertical speed value ($V_2$).

It is also advantageous if the vertical speed of the load-lifter member is held at a first vertical speed value ($V_1$) with a repeated off and on switching of the on-off switch where the period between a switching off process and the subsequent switching on process does not exceed a specific duration $T_2$.

The period $T_1$ is advantageously between 1 and 3 seconds.

It is particularly advantageous if the period $T_1$ is between 1.3 and 2.1 seconds.

The time $T_2$ is advantageously between 0.2 and 1 second.

The time $T_2$ is particularly advantageously between 0.3 and 0.8 seconds.

The problem posed by the invention for an industrial truck is solved in that the actuating device has at least one single or multistage switch.

Such a single or multistage switch can be made very small structurally and thus can be located at ergonomically favorable sites on the industrial truck.

A further refinement of the invention consists in the fact that the actuating device is in working connection with a control unit and that the control unit is in working connection with at least one actuator.

In a particularly advantageous refinement of the invention, at least one actuator is designed as a proportioning control magnet for a hydraulic proportioning valve. The vertical speed of the load-lifting member is continuously established with the hydraulic proportioning valve. The proportioning control magnet thus permits a continuous adjustment of the hydraulic proportioning valve. The control magnet is in turn in working connection with the control unit and is supplied with current by the latter.

In an advantageous further refinement of the invention, a pulse-like electrical direct current produced in the control unit represents the working connection of the control unit with the actuator. A proportioning control magnet as actuator generates a non-pulsating magnetic field continuously adjustable in strength.

In an additional refinement of the invention, at least one actuator is designed as a control magnet for a hydraulic directional control valve.

Another refinement of the invention results if at least one actuator is designed as a switching relay for an electric drive motor of a hydraulic pump.

A particularly advantageous embodiment of the invention consists in the fact that at least one on-off switch is located in the region of the handle of a center pole. Such an arrangement of the switch is ergonomically particularly favorable because a frequent switching from the handle to the switches for the vertical movement of the load-lifter member is avoided.

BRIEF DESCRIPTION OF THE DRAWINGS

Additional advantages and embodiments of the invention are elucidated in greater detail with reference to the implementation examples shown in the schematic figures.

DETAILED DESCRIPTION OF THE PREFERRED EMBODIMENT

Figure 1:
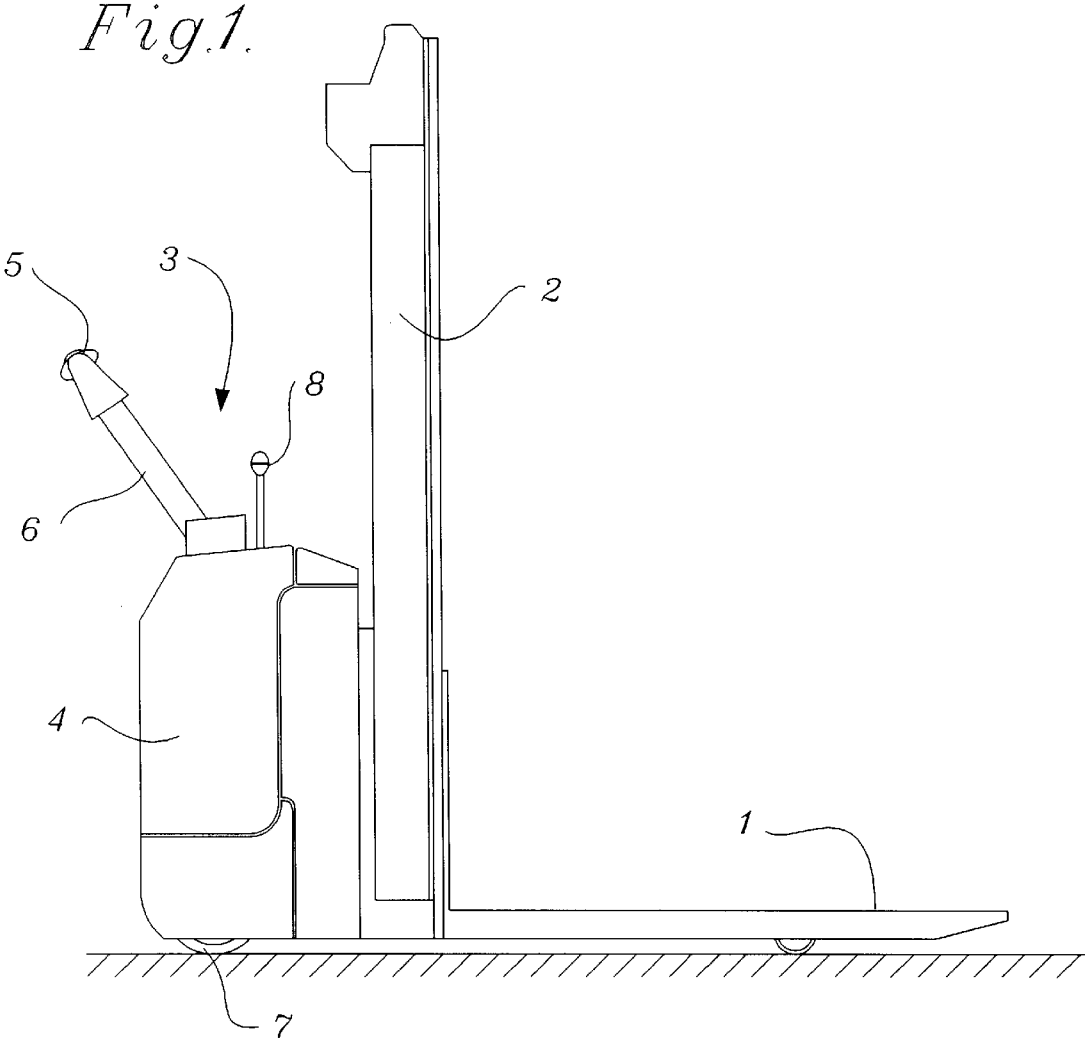
FIG. 1 shows an industrial truck.

An industrial truck is shown in FIG. 1. A load-lifting device 1 can be moved up and down in the vertical direction on a lift stand 2. The driving part 3 of the industrial truck is located on the other side of the lift stand 2. Drive units for travel and for the vertical movement of the load-lifting member are located inside of the housing 4. An actuating device 5 for the travel drive is located on a center pole 6 which is coupled with the drive gear 7 and thus permits the steering of the industrial truck. An actuating device 8 for the vertical movement of the load-lifting member is located on the housing 4.

Figure 2:
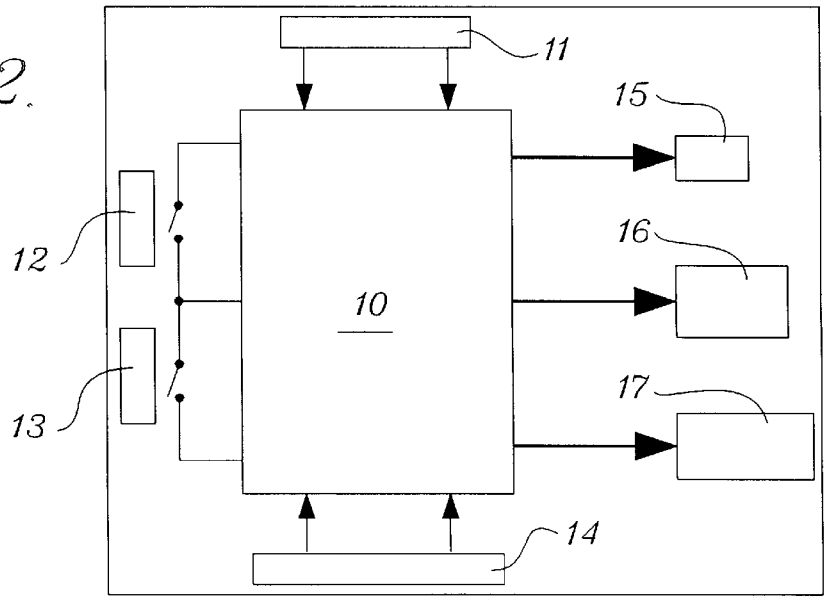
FIG. 2 shows a schematic presentation of the method according to the invention.

The process according to the invention is shown schematically in FIG. 2. A control unit 10 is supplied here by a current source 11 with the electrical voltage of 24 volts available in the industrial truck. Control signals are given by an attendant for the vertical up and down movement of the load-lifting member by means of an on-off switch 12 for the upward movement and a second on-off switch 13 for the downward movement and fed to the control unit 10. Electrical elements are involved in the two on-off switches 12 and 13. A transmitter 14 for additional information, for example, information on the weight of the load or on the distance from the floor of the load-lifting member 1 is also fed to the control unit 10. Three regulating signals for three actuators are produced in the control unit 10. In the actuators there is a control magnet 15 for a hydraulic directional control valve, a proportional control magnet 17 for a hydraulic proportioning valve and a switching relay 16 for an electric drive motor of a hydraulic pump. In the case of the regulating signals for the control magnet 15 of the hydraulic directional valve and for the switching relay 16 of the electric drive motor there are electric direct currents. The regulating signal for the proportioning control magnet 17 has on the other hand the form of a pulse-like electric direct current. The field strength of the proportional control magnet 17 is adjusted here by the pulse ratio of the regulating signal.

Figure 3:
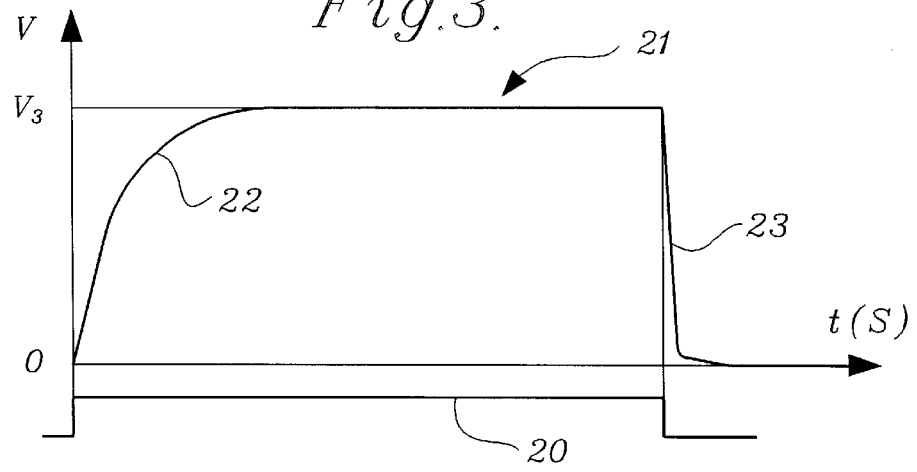
FIG. 3 shows the course of the speed in raising the load-lifting member.

The course 21 of the speed of the load-lifting member 1 in a vertical direction of upward movement is shown in FIG. 3. Only one vertical speed is provided for the upward movement; it is between 12 and 20 cm/sec, depending on the load. The actuating of the on-off switch 12 for the vertical upward movement performed by the attendant is shown in FIG. 3 by the curve 20. It can be deduced from the course 21 of the speed that the load-lifting member is accelerated approximately identically in time with the actuation of the switch 12 along a speed ramp 22 and the maximum speed attained is held until the switch 20 is switched off. The load-lifting member is then braked along a prescribed ramp 23. The shapes and slopes of the ramps 22 and 23 are prescribed in the control unit 10 and produced by appropriate regulating signals at the magnetic proportional valve 17.

Figure 4:
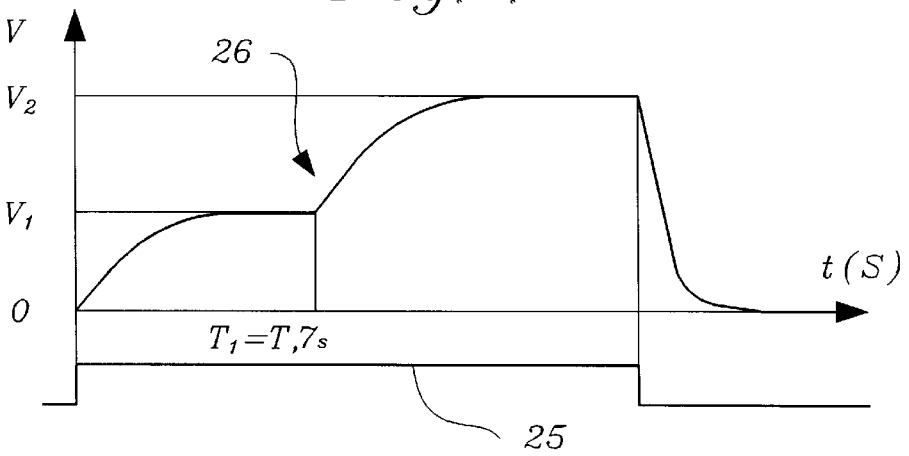
FIG. 4 shows the course of the speed in lowering the load-lifting member.

FIG. 4 plots the course 26 of the vertical speed for a downward movement of the load-lifting member 1. The actuation of the on-off switch 13 for the vertical downward movement performed by the attendant is illustrated by curve 25. When the on-off switch 13 is held in the on position, the load-lifting member is first accelerated to a first vertical speed value V1. The acceleration to a second vertical speed value V2 takes place in this implementation example after T1=1.7 seconds after the first switching on of the switch 13. After the switch 13 is switched off, the load-lifting member is braked approximately without time delay.

Figure 5:
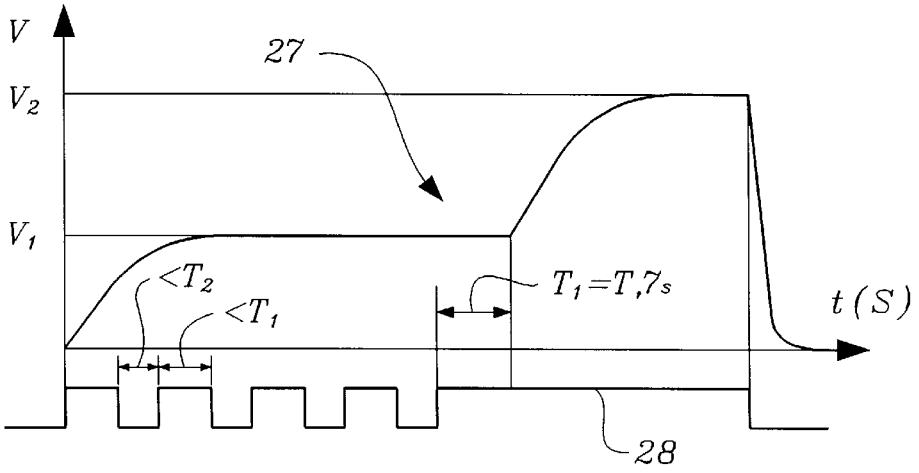
FIG. 5 shows another course of the speed during lowering.

Another course of the vertical speed in a downward movement is shown in FIG. 5. The actuation of the switch 13 for the vertical downward movement by the attendant is illustrated by curve 28. A repeated switching off and on leads to holding the vertical downward movement to the value V1. The time period between a switching off process and the subsequent switching on process may not exceed a time of $T_2$=0.5 seconds. Otherwise, the load-lifting member would be braked. If the switch 13 is held in the on position for a longer time than $T_1$=1.7 seconds, an acceleration of the load-lifting member to the speed value $V_2$ takes place.

In the vertical downward movement of the load-lifting member 1, according to FIGS. 4 and 5, all the speed changes also occur along ramp functions that are generated in the control unit 10. In this implementation example, the period $T_1$=1.7 seconds and the time $T_2$=0.5 second. The first vertical downward speed $V_1$ has a value between 10 and 20 cm/sec. as a function of the size of the load; the maximum prescribed vertical downward speed $V_2$ has a value of 35 cm/sec.

Figure 6:
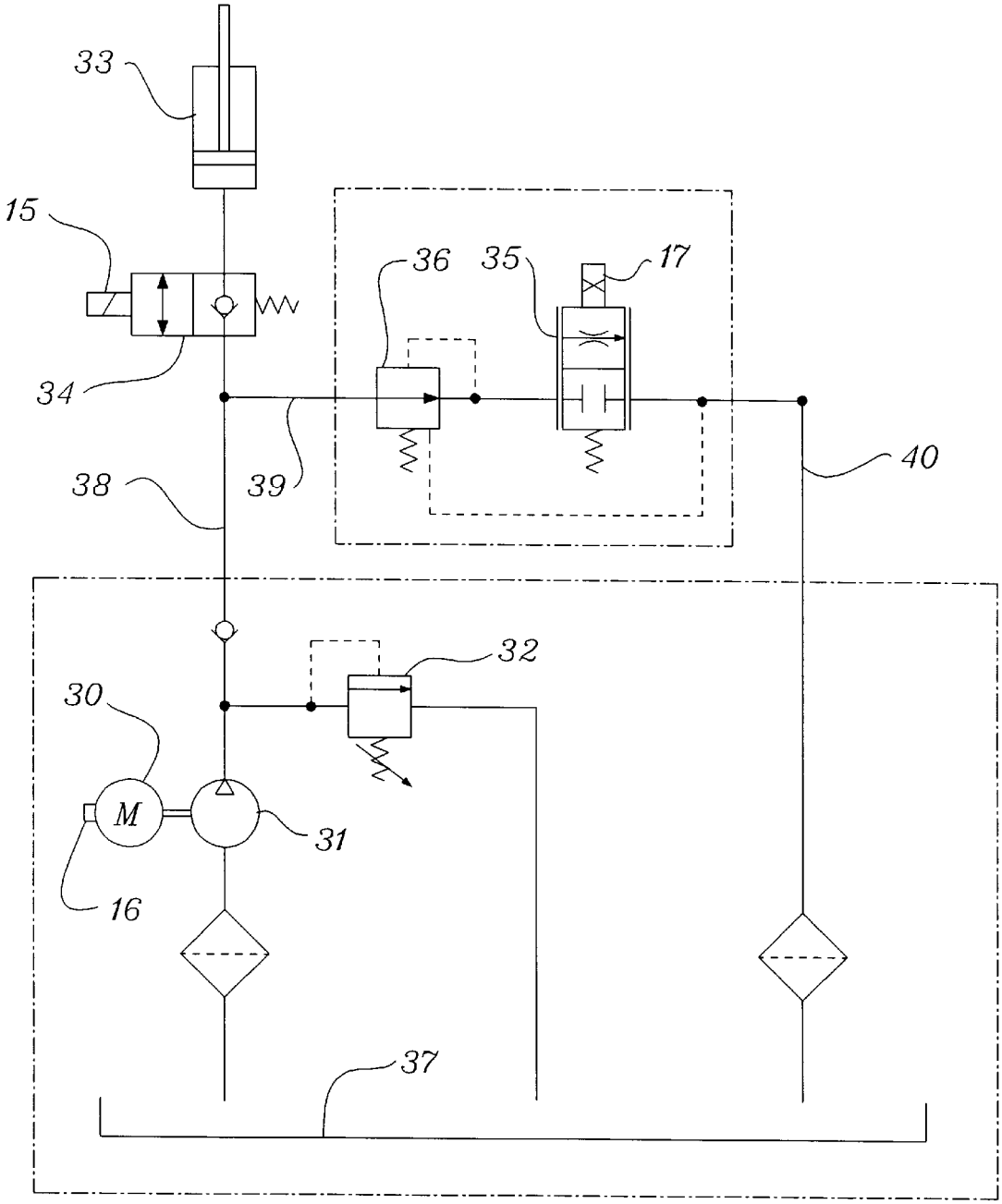
FIG. 6 shows the arrangement of the actuators according to the invention.

FIG. 6 shows an arrangement of the actuators in a hydraulic connection diagram. The industrial truck according to the invention has a hydraulic pump 31 driven by the motor 30 and a pressure limiting valve 32. The hydraulic pump 31 is connected through a line 38 with a lifting cylinder 33. A directional valve 34 is positioned in front of the lifting cylinder 33; it can e switched by means of the control magnet 15. A branch line 39 leads from the line 38 upstream of the directional valve 34 to a hydraulic proportional valve 35. A flow limited valve 36 is located ahead of the hydraulic proportional valve 35 which can be controlled by the proportional control magnet 17. A line 40 leads from the hydraulic proportional valve 35 to a tank 37.

If the load-lifting member connected with the lifting cylinder 33 is not moved, the valves are then in the position shown and the pump 31 is not in operation. A backflow of hydraulic oil from the lifting cylinder 33 is prevented by the directional valve 34.

In order to effect a raising of the load-lifting member 1 starting from here, the following processes are unleashed by the control unit 10. The proportional valve 35 is opened completely and then the pump 31 is set in operation. A load-free starting of the pump is thus assured because the hydraulic oil delivered by the pump is fed back by the proportional valve 35 directly into the tank 37. If the proportional valve 35 is then slowly closed and thus, the volume stream delivered by the pump 31 is fed to the lifting cylinder 33, the load-lifting member 1 is raised. The directional valve 34 is not moved for raising the load-lifting member 1.

In order to effect a vertical downward movement again starting from a stationary load-lifting member 1, the following processes are unleased by the control unit 10.

The directional valve 34 is first opened. Then the proportional valve 35 is opened in accordance with the ramp functions prescribed by the control unit and according to the prescribed vertical speed $V_1$, $V_2$. The oil in the lifting cylinder 33 can thus flow off through the proportional valve 35 into the tank 37.

With the proposed process and proposed apparatus it is possible to locate the operating device for the vertical movement of the load-lifting member at an ergonomically favorable site and at the same time provide different vertical speeds with jerk free speed transitions.

While certain presently preferred embodiments of the present invention have been described and illustrated, it is to be distinctly understood that the invention is not limited thereto but may be otherwise embodied and practiced within the scope of the following claims.

We claim:

1. Method for operating an industrial truck in which a load-lifting member (1) is moved vertically up and down on a lift mast (2) and the vertical speed of the load-lifting member (1) is prescribed by an actuating device, wherein a discrete control signal for the vertical speed of the load-lifting member (1) is prescribed by at least one on-off switch (12, 13), wherein the vertical upward movement and/or the vertical downward movement takes place with two different vertical speeds ($V_1$, $V_2$) and that the discrete control signals for the vertical upward movement and the discrete control signals for the vertical downward movement are produced with an on-off switch (12, 13) and wherein when the on-off switch (13) is switched on and then held in the on position, the load-lifting member (1) is first accelerated from zero to a first vertical speed value ($V_1$) and after the passage of a period of time $T_1$ is accelerated to a second, higher vertical speed value ($V_2$) after switching on.

2. Method for operating an industrial truck according to claim 1, wherein with a repeated switching on and off of the on-off switch (13), where the period between the switching off process and the following switching on process does not exceed a specific duration $T_2$, the vertical speed of the load-lifting member (1) is held at the first vertical speed value ($V_1$).

3. Method for operating an industrial truck according to claim 1, wherein after a period $T_1$ of 1 to 3 seconds after the on-off switch (13) is switched on, it is accelerated to the second vertical speed ($V_2$).

4. Method for operating an industrial truck according to claim 1, wherein after a period $T_1$ of 1.3 to 2.1 seconds after the on-off switch is switched on, it is accelerated to the second vertical speed ($V_2$).

5. Method for operating an industrial truck according to claim 1, wherein after a switching off and a following switching on of the on-off switch within the period $T_2$ of 0.2 to 1.0 second, the first vertical speed ($V_1$) is maintained.

6. Method for operating an industrial truck according to claim 2, wherein after a switching off and a subsequent switching on of the on-off switch, within a period $T_2$ of 0.3 to 0.8 second, the first vertical speed ($V_1$) is maintained.

7. Industrial truck with a load-lifting member (1) vertically moveable on a lift mast (2) and an actuating device for the vertical movement of the load-lifting member (1), wherein the actuating device has at least one single or multistage switch, wherein the actuating device is in working connection with a control unit (10) and that the control unit (10) is in working connection with at least one actuator, wherein at least one actuator is designed as a proportional control magnet (17) for a hydraulic proportional valve (35) and wherein a pulse like electric direct current generated by the control unit (10) represents the working connection of the control unit (10) with the actuator.

* * * * *